US011845633B2

(12) United States Patent
Babu

(10) Patent No.: US 11,845,633 B2
(45) Date of Patent: Dec. 19, 2023

(54) OVERLOAD VALVE ASSEMBLY FOR A PNEUMATIC VACUUM ELEVATOR

(71) Applicant: Killakathu Ramanathan Babu, Tamilnadu (IN)

(72) Inventor: Killakathu Ramanathan Babu, Tamilnadu (IN)

(73) Assignee: Killakathu Ramanathan Babu

( * ) Notice: Subject to any disclaimer, the term of this patent is extended or adjusted under 35 U.S.C. 154(b) by 0 days.

(21) Appl. No.: 17/928,631

(22) PCT Filed: May 31, 2021

(86) PCT No.: PCT/IB2021/054766
§ 371 (c)(1),
(2) Date: Nov. 30, 2022

(87) PCT Pub. No.: WO2021/245537
PCT Pub. Date: Dec. 9, 2021

(65) Prior Publication Data

US 2023/0139084 A1 May 4, 2023

(30) Foreign Application Priority Data

Jun. 2, 2020 (IN) ..... 202041023093

(51) Int. Cl.
*B66B 5/14* (2006.01)
*B66B 9/04* (2006.01)

(52) U.S. Cl.
CPC . *B66B 5/14* (2013.01); *B66B 9/04* (2013.01)

(58) Field of Classification Search
CPC ..... B66B 5/14; B66B 9/04
See application file for complete search history.

(56) References Cited

U.S. PATENT DOCUMENTS

2002/0153204 A1* 10/2002 Veletovac ..... B66B 9/04 187/285
2023/0136840 A1* 5/2023 Babu ..... B66B 11/004 187/250
2023/0137918 A1* 5/2023 Babu ..... B66B 9/04 187/250

FOREIGN PATENT DOCUMENTS

CN 105819309 B 12/2017
EP 0550904 A1 7/1993
KR 20180073037 A 7/2018
WO WO-2021245536 A1 * 12/2021

* cited by examiner

*Primary Examiner* — Jeffrey Donels
(74) *Attorney, Agent, or Firm* — Jason C. Cameron

(57) ABSTRACT

An overload valve assembly for a pneumatic vacuum elevator is disclosed. The overload valve assembly for a pneumatic vacuum elevator is characterised by a fastening means, a pad with a centre hole, an arresting plate with a centre hole, a disc plate with a centre hole, a bottom bush, a spring and a top bush bounded with a nut. Here, the pad, the arresting plate, the disc plate, the bottom bush, the spring and the top bush bounded with the nut is fitted over the fastening means. The overload valve unit is configured to function based on spring actuation mechanism and ensure the maximum permissible limit of pay load in the elevator cabin assembly.

8 Claims, 6 Drawing Sheets

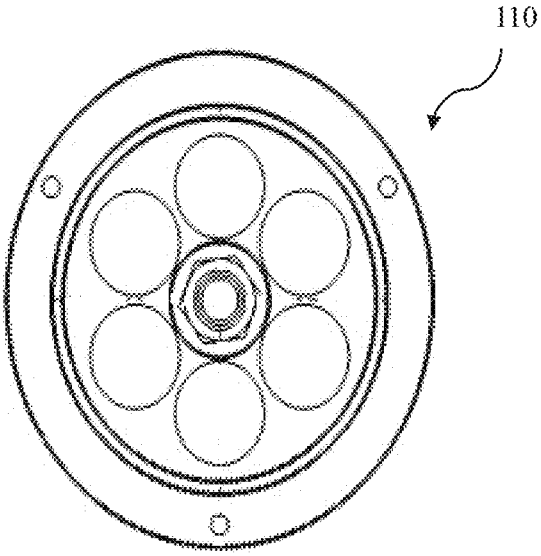
FIG. 3 (a)
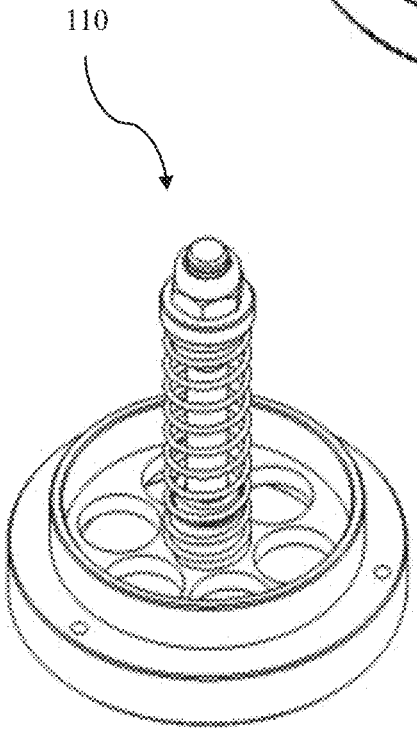
FIG. 3 (b)
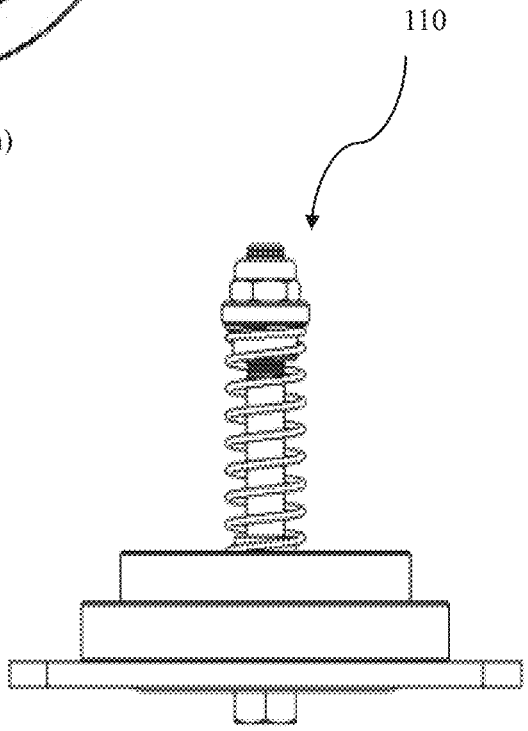
FIG. 3 (c)
FIG. 3

OVERLOAD VALVE ASSEMBLY FOR A PNEUMATIC VACUUM ELEVATOR

CROSS-REFERENCE TO RELATED APPLICATION

This Application claims priority from a Patent application filed in India having Patent Application No. 202041023093, filed on Jun. 2, 2020, and titled "OVERLOAD VALVE ASSEMBLY FOR A PNEUMATIC VACUUM ELEVATOR" and a PCT Application No. PCT/IB2021/054766 filed on May 31, 2021, and titled "OVERLOAD VALVE ASSEMBLY FOR A PNEUMATIC VACUUM ELEVATOR".

FIELD OF INVENTION

Embodiments of a present disclosure relates to a pneumatic vacuum elevator, and more particularly to an overload valve assembly for a pneumatic vacuum elevator.

BACKGROUND

In conventional approach, mechanical elevators use countervailing weights in order to facilitate moving up and down of a passenger cabin. Such, typical elevators require a great deal of space, maintenance, equipment and machinery. The pneumatic vacuum elevator uses air pressure to cause motion of the passenger cabin within a thoroughfare or tubular cylinder. The mechanism uses the air within the tubular cylinder as a working fluid. Brakes, motors, valves, electronic controls and other equipment work in tandem to ensure a safe and pleasant riding experience for each occupant therein.

For ideal operation of pneumatic vacuum elevator, the load inside an elevator cabin (CAR) assembly must not exceed the permissible load limit, so that the elevator cabin (CAR) assembly may traverse safely inside the cylinder assembly of the elevator without any malfunction. In current approach, load cells are being used to determine the real time weight of the elevator cabin (CAR) assembly. In such mechanism, elevator provides alerts if predetermined weight is crossed. Here, detection may be incorrect due to malfunction of load cells. An effective mechanism would be to use an automatic and reliable overload detection system, whereby the system may give alert after judging maximum permissible limit of pay load in real time and halt the operation of pneumatic vacuum elevator to prevent any mishap.

Hence, there is a need for an overload valve assembly for a pneumatic vacuum elevator to address the aforementioned issues.

BRIEF DESCRIPTION

In accordance with one embodiment of the disclosure, an overload valve assembly for a pneumatic vacuum elevator is disclosed. The overload valve assembly for a pneumatic vacuum elevator comprises an overload valve unit. The overload valve unit is housed in a head cylinder. The overload valve unit is connected to top of an elevator cabin (CAR) assembly. The overload valve unit is configured to function based on spring actuation mechanism and ensure the maximum permissible limit of pay load in the cabin assembly.

The overload valve assembly is characterised by a fastening means. The fastening means is mechanically oriented in an inverted position and affixed over outer top surface of the elevator cabin (CAR) assembly. The overload valve assembly is also characterised by a pad with a centre hole. The pad is inserted into the fastening means. The pad is adapted to rest over lower end of the fastening means.

The overload valve assembly is also characterised by an arresting plate with a centre hole. The arresting plate is inserted into the fastening means. The arresting plate is adapted to rest above the pad. The arresting plate and the pad are tightly held over lower end of the fastening means by a C-shaped clip. The overload valve assembly is also characterised by a disc plate with a centre hole. The disc plate is inserted into the fastening means and mechanically coupled to lower side of the head cylinder. The disc plate comprises extrusion around circumference of the disc plate at lower side, extrusion around the centre hole, and a plurality of holes for out flow of air.

The overload valve assembly is also characterised by a bottom bush. The bottom bush is inserted into the fastening means and housed inside the extrusion at the centre hole of the disc plate. The bottom bush is adapted to act as an insulator by insulating the fastening means from the disc plate. The overload valve assembly is also characterised by a spring of predetermined spring force. The spring is inserted into the fastening means and rests above the disc plate. The overload valve assembly is also characterised by a top bush bounded with a nut. The top bush enables fastening of the spring with the disc plate from top end of the fastening means.

In accordance with one embodiment of the disclosure, a pneumatic vacuum elevator, ensuring a maximum permissible limit of pay load in elevator cabin (CAR) assembly, is discloses. The pneumatic vacuum elevator includes an elevator cylinder which is adapted to house pneumatic vacuum elevator components. The pneumatic vacuum elevator components include a head cylinder mechanically affixed just below the ceiling of the top floor for housing an elevator cabin structural sealing unit, at least one motor and an overload valve assembly, where the overload valve assembly is configured to function based on spring actuation mechanism and ensure a maximum permissible limit of pay load in elevator cabin (CAR) assembly.

The pneumatic vacuum elevator components also include an elevator cabin (CAR) assembly. The elevator cabin (CAR) assembly is positioned below the head cylinder and adapted for upward and downward movement through one or more floor levels. The pneumatic vacuum elevator components also include an intermediate cylinder assembly mechanically affixed in between each of the one or more floor levels. The intermediate cylinder assembly is adapted to provide requisite space for easy movement of the elevator cabin (CAR) assembly between each of the one or more floor levels.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which:

FIG. 3 (*a*) is a schematic representation of top view of the overload valve assembly (110) in accordance with an embodiment of the present disclosure;

FIG. 3 (*b*) is a schematic representation of isometric view of the overload valve assembly (110) in accordance with an embodiment of the present disclosure;

FIG. 3 (*c*) is a schematic representation of front view of the overload valve assembly (110) in accordance with an embodiment of the present disclosure;

Figure 1:
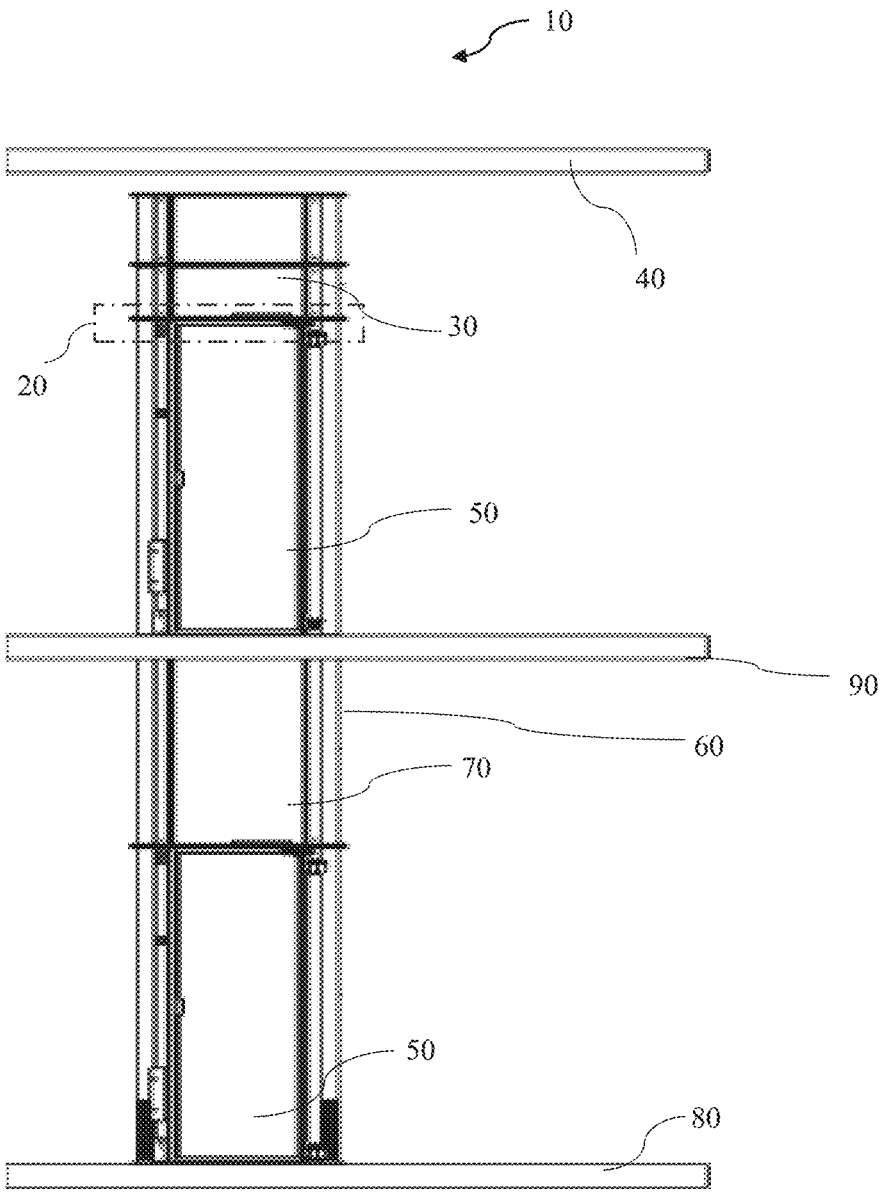
FIG. 1 is a schematic representation of a pneumatic vacuum elevator in accordance with an embodiment of the present disclosure.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated online platform, and such further applications of the principles of the disclosure as would normally occur to those skilled in the art are to be construed as being within the scope of the present disclosure.

The terms "comprises", "comprising", or any other variations thereof, are intended to cover a non-exclusive inclusion, such that a process or method that comprises a list of steps does not include only those steps but may include other steps not expressly listed or inherent to such a process or method. Similarly, one or more devices or subsystems or elements or structures or components preceded by "comprises . . . a" does not, without more constraints, preclude the existence of other devices, subsystems, elements, structures, components, additional devices, additional subsystems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Embodiments of the present disclosure relate to an overload valve assembly for a pneumatic vacuum elevator is disclosed. The overload valve assembly for a pneumatic vacuum elevator comprises an overload valve unit. The overload valve unit is housed in a head cylinder. The overload valve unit is connected to top of an elevator cabin (CAR) assembly. The overload valve unit is configured to function based on spring actuation mechanism and ensure the maximum permissible limit of pay load in the cabin assembly.

The overload valve assembly is characterised by a fastening means. The fastening means is mechanically oriented in an inverted position and affixed over outer top surface of the elevator cabin (CAR) assembly. The overload valve assembly is also characterised by a pad with a centre hole. The pad is inserted into the fastening means. The pad is adapted to rest over lower end of the fastening means.

The overload valve assembly is also characterised by an arresting plate with a centre hole. The arresting plate is inserted into the fastening means. The arresting plate is adapted to rest above the pad. The arresting plate and the pad are tightly held over lower end of the fastening means by a C-shaped clip. The overload valve assembly is also characterised by a disc plate with a centre hole. The disc plate is inserted into the fastening means and mechanically coupled to lower side of the head cylinder. The disc plate comprises extrusion around circumference of the disc plate at lower side, extrusion around the centre hole, and a plurality of holes for out flow of air.

The overload valve assembly is also characterised by a bottom bush. The bottom bush is inserted into the fastening means and housed inside the extrusion at the centre hole of the disc plate. The bottom bush is adapted to act as an insulator by insulating the fastening means from the disc plate. The overload valve assembly is also characterised by a spring of predetermined spring force. The spring is inserted into the fastening means and rests above the disc plate. The overload valve assembly is also characterised by a top bush bounded with a nut. The top bush enables fastening of the spring with the disc plate from top end of the fastening means.

FIG. 1 is a schematic representation of a pneumatic vacuum elevator 10 in accordance with an embodiment of the present disclosure. As used herein, the machine "pneumatic elevators" utilize air pressure to lift the elevator cabin 50, in such embodiment, a vacuum seal built into the ceiling enables lifting of the elevator cabin through the elevator cabin housing. The pneumatic vacuum elevator 10 comprises an elevator cylinder 60. The elevator cylinder 60 is adapted to house the pneumatic vacuum elevator 10 components.

The pneumatic vacuum elevator 10 components comprises a head cylinder 30. The head cylinder 30 is mechanically affixed just below ceiling 40 of the top floor 90. The head cylinder 30 is adapted for housing the elevator cabin structural sealing unit 20, at least one motor and an overload valve assembly. Each of the at least one motor delivers necessary power for total functioning of the elevator during operation.

The pneumatic vacuum elevator 10 components also comprises a cylindrical elevator cabin (CAR) 50 assembly. The cylindrical elevator cabin (CAR) 50 assembly is positioned below the head cylinder 30. The cylindrical elevator cabin (CAR) 50 assembly is adapted to provide an elevator housing for upward and downward movement through one or more floor levels 80 and 90.

The pneumatic vacuum elevator 10 components also comprises an intermediate cylinder assembly 70. The intermediate cylinder assembly 70 is mechanically affixed in between each of the one or more floor levels 80 and 90. The intermediate cylinder assembly 70 is adapted to provide requisite space for easy movement of the cylindrical elevator cabin (CAR) 50 assembly between each of the one or more floor levels 80 and 90.

Figure 2:
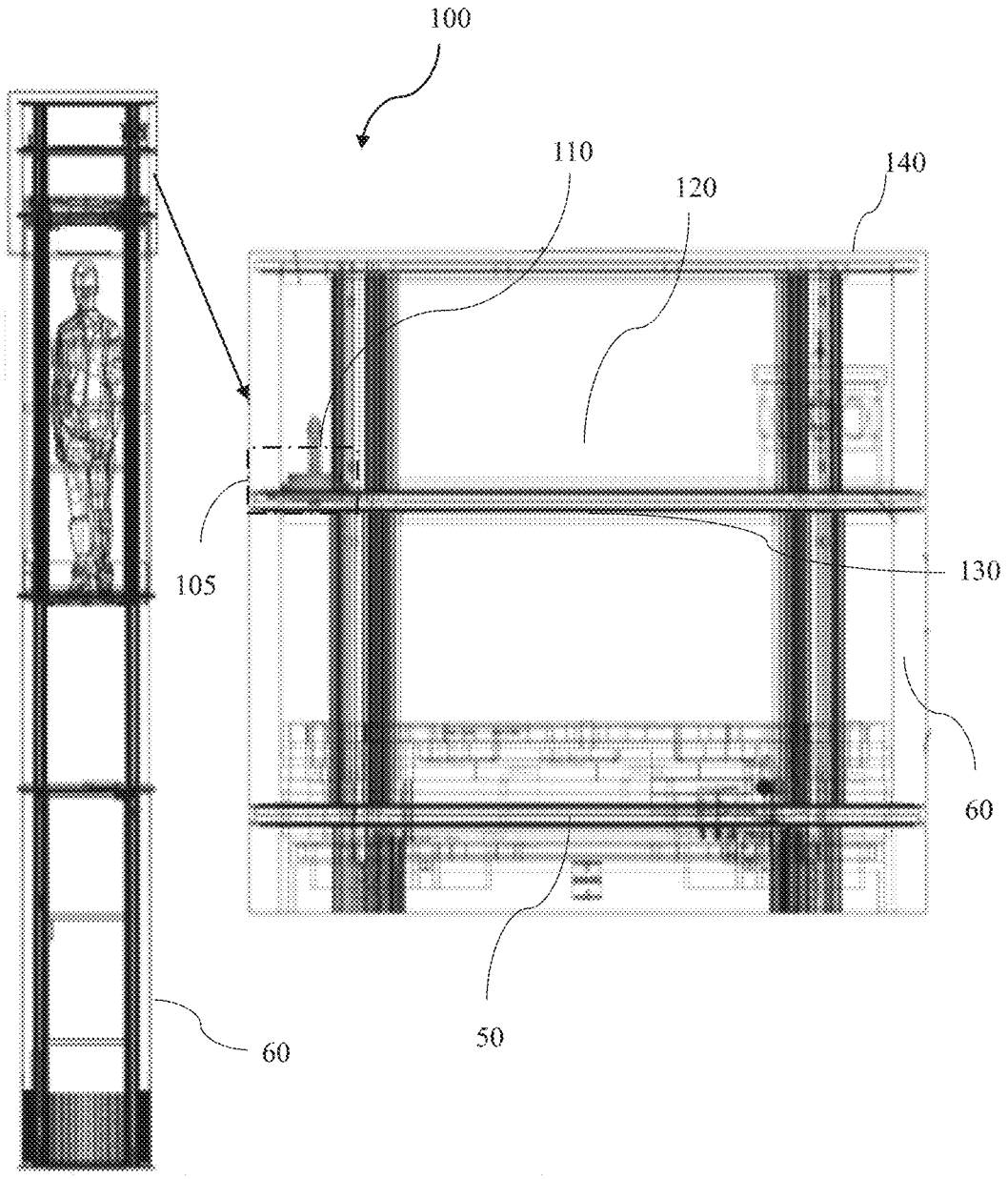
FIG. 2 is a schematic representation of an overload valve assembly in conjunction with a pneumatic vacuum elevator in accordance with an embodiment of the present disclosure.

FIG. 2 is a schematic representation of the overload valve assembly 110 in conjunction with a pneumatic vacuum elevator 100 in accordance with an embodiment of the present disclosure. The overload valve assembly 110 is housed in a head cylinder 30 (as shown in FIG. 1) and principally connected to the top of an elevator cabin (CAR) 50 assembly. As stated above, all such pneumatic vacuum elevator 10 (as shown in FIG. 1) components are housed in elevator cylinder 60. In such embodiment, the overload valve assembly 110 is housed just above the bottom surface 130 housing a motor assembly 120. In such embodiment, the overload valve assembly 110 is affixed near top portion 140 of elevator cylinder 60 to detect the weight of the elevator cabin (CAR) 50 assembly effectively.

FIG. 3 (*a*) is a schematic representation of top view of the overload valve assembly 110 in accordance with an embodiment of the present disclosure. FIG. 3 (*b*) is a schematic representation of isometric view of the overload valve assembly 110 in accordance with an embodiment of the present disclosure. FIG. 3 (*c*) is a schematic representation of front view of the overload valve assembly 110 in accordance with an embodiment of the present disclosure. FIGS. 3(*a*), (*b*) and (*c*) basically provides assembled orthographic views of the overload valve assembly 110. The overload valve assembly 110 basically comprises of components such as a fastening means, a pad, an arresting plate, a disc plate fabricated with extrusions, a spring, a number of bush and a nut characterised for tightly holding the components together. In an embodiment, the fastening means used may be a rod, a bolt, an Allen bolt, a stud bolt or a screw.

Figure 4:
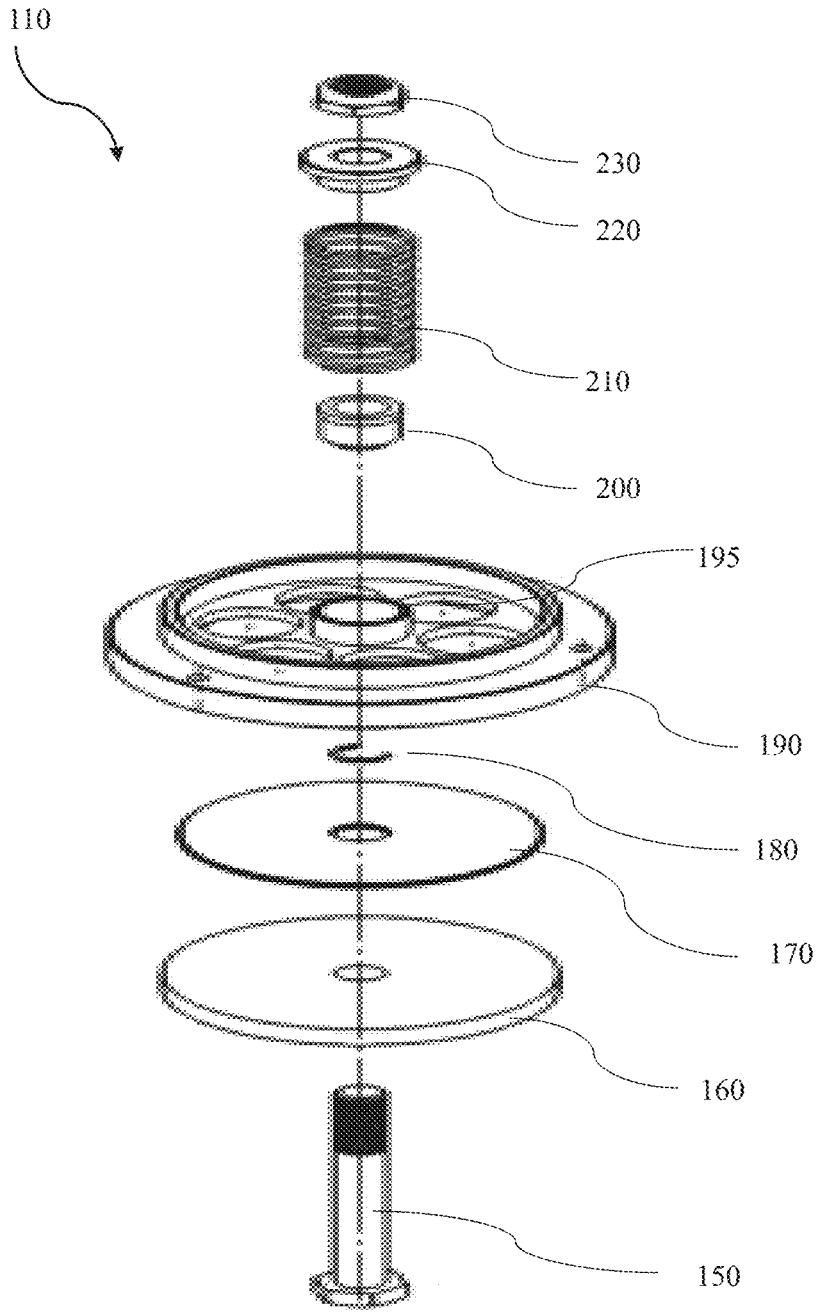
FIG. 4 is an exploded view representation of the overload valve assembly in accordance with an embodiment of the present disclosure.

FIG. 4 is an exploded view representation of arrangement of various components of the overload valve assembly 110 in accordance with an embodiment of the present disclosure. The overload valve assembly 110 for the pneumatic vacuum elevator 10 comprises an overload valve unit 105 (as shown in FIG. 2). The overload valve unit 105 is housed in a head cylinder 30 and connected to top of an elevator cabin (CAR) 50 assembly. The overload valve unit 105 is configured to function based on spring actuation mechanism and ensure the maximum permissible limit of pay load in the elevator cabin (CAR) 50 assembly.

The overload valve assembly 110 is characterised by a fastening means 150. The fastening means 150 is mechanically oriented in an inverted position. In one specific embodiment, the type of fastening means used may be a hexagonal fastening means 150. The fastening means 150 is affixed over outer top surface of the elevator cabin (CAR) 50 assembly.

The overload valve assembly 110 is also characterised by a pad 160. The pad 160 is configured with a centre hole for the procedure of insertion into the fastening means 150. The pad 160 is adapted to rest over lower end of the fastening means 150. In one embodiment, the pad is fabricated with nylon, plastic, polycarbonate, medium-density fibreboard or any non-conduction material. It is pertinent to note that, the use of non-conducting material enables insulation from unnecessary electrical conductivity. In one specific embodiment, the pad 160 may be fabricated in circular shape.

The overload valve assembly 110 is also characterised by an arresting plate 170. The arresting plate 170 is characterised with a centre hole for the procedure of insertion into the fastening means 150. The arresting plate 170 is adapted to rest above the pad 160. In one embodiment, the arresting plate 170 is fabricated with steel, aluminium or any other similar conducting material. In one embodiment, the arresting plate 170 may be fabricated in circular shape.

In one specific embodiment, the arresting plate 170 and the pad 160 are tightly held over lower end of the fastening means 150 by a C-shaped clip 180, In such embodiment, the C-shaped clip 180 basically locks the arresting plate 170 and the pad 160 with the fastening means 150.

The overload valve assembly 110 is also characterised by a disc plate 190. The disc plate 190 is characterised with a centre hole for the procedure of insertion into the fastening means 150. The disc plate 190 is mechanically coupled to lower side of the head cylinder 30. In one specific embodiment, the disc plate 190 comprises extrusion around circumference of the disc plate 190 at lower side, extrusion around the centre hole, and a plurality of holes 195. In one embodiment, the plurality of holes 195 may enable outflow of air during overload valve assembly 110 operation. In another embodiment, the disc plate 190 is fabricated with steel, aluminium or any other similar conducting material.

In one specific embodiment, the extrusion around the centre hole is fabricated in upward direction. In such embodiment, the extrusion around the centre hole enable holding of components on the above portion of the overload valve assembly 110. In another specific embodiment, the extrusion at lower side is fabricated in downward direction. In such embodiment, the extrusion at lower side is adapted to house the arresting plate 170 and the pad 160.

Furthermore, in another specific embodiment, the arresting plate 170 and the pad 160 is adapted to move in tandem from a closed position to an open position. At the closed position, the arresting plate 170 covers the plurality of holes 195, thereby preventing the out flow of air and completing a power circuit. The arresting plate 170 is configured to be pushed down to move to the open position, thereby uncovering the plurality of holes 195 and enabling the out flow of air and disconnecting the power circuit.

The overload valve assembly 110 is also characterised by a bottom bush 200. The bottom bush 200 is inserted into the fastening means 150 and housed inside the extrusion at the centre hole of the disc plate 190. The bottom bush 200 is adapted to act as an insulator by insulating the fastening means 150 from the disc plate 190. In such embodiment, the bottom bush 200 may be fabricated in circular shape. In one embodiment, the bottom bush 200 is fabricated with nylon, plastic, polycarbonate, medium-density fibreboard and any non-conduction material.

Moreover, the overload valve assembly 110 is also characterised by a spring 210 of pre-determined spring force. The spring 210 is inserted into the fastening means 150 and rests above the disc plate 190. As used herein, the term "spring force" is the force exerted by a compressed or stretched spring upon any object that is attached to it.

In one embodiment, the spring 210 is adapted to provide spring actuation movement for the movement of the arresting plate 170 and the pad 160 from the closed position to the open position upon detecting a load in the elevator cabin (CAR) 50 assembly more than the permissible limit of pay load.

The arresting plate 170 and the pad 160 are pulled down via the fastening means when one or more users of permissible weight enters into the CAR, however the arresting plate 170 remains closely affixed onto the bottom of the disc plate 190 while covering the plurality of holes 195. This happens because the pre-determined spring force of the spring is calibrated hold to the permissible weight. In an event, when the weight in the CAR exceeds the permissible weight limit the arresting plate 170 is pulled down further thus actuating the spring (where the spring is compressed and unable to hold the arresting plate 170 tightly affixed to the bottom of disc plate 190, this allows the arresting plate 170 to move down and pulled away from the bottom of the disc plate 190 thus opening the plurality of holes 195 and disconnecting the power circuit. This works as an impeccable safety mechanism by bringing the operation of the elevator to halt. Further, when load in the CAR is removed or adjusted to be within the permissible weight limit, the spring gets back to its decompressed state, thus pulling up the arresting plate 170 onto the bottom of the disc plate 190 and thereby closing the plurality of holes 195 and completing the power circuit again.

The overload valve assembly 110 is also characterised by a top hush 220 bounded with a nut 230. Such structural arrangement enables fastening of the spring 210 with the disc plate 190 from top end of the fastening means 150. In one embodiment, a control panel is positioned above the top end of the hexagonal fastening means 150. In another embodiment, the overload valve assembly 110 may use NyLok nut for tightening. In yet another embodiment, the top bush 200 may be fabricated in circular shape to act as a non-conduction device. The top bush 220 is fabricated with nylon, plastic, polycarbonate, medium-density fibre board and any non-conduction material.

Figure 5:
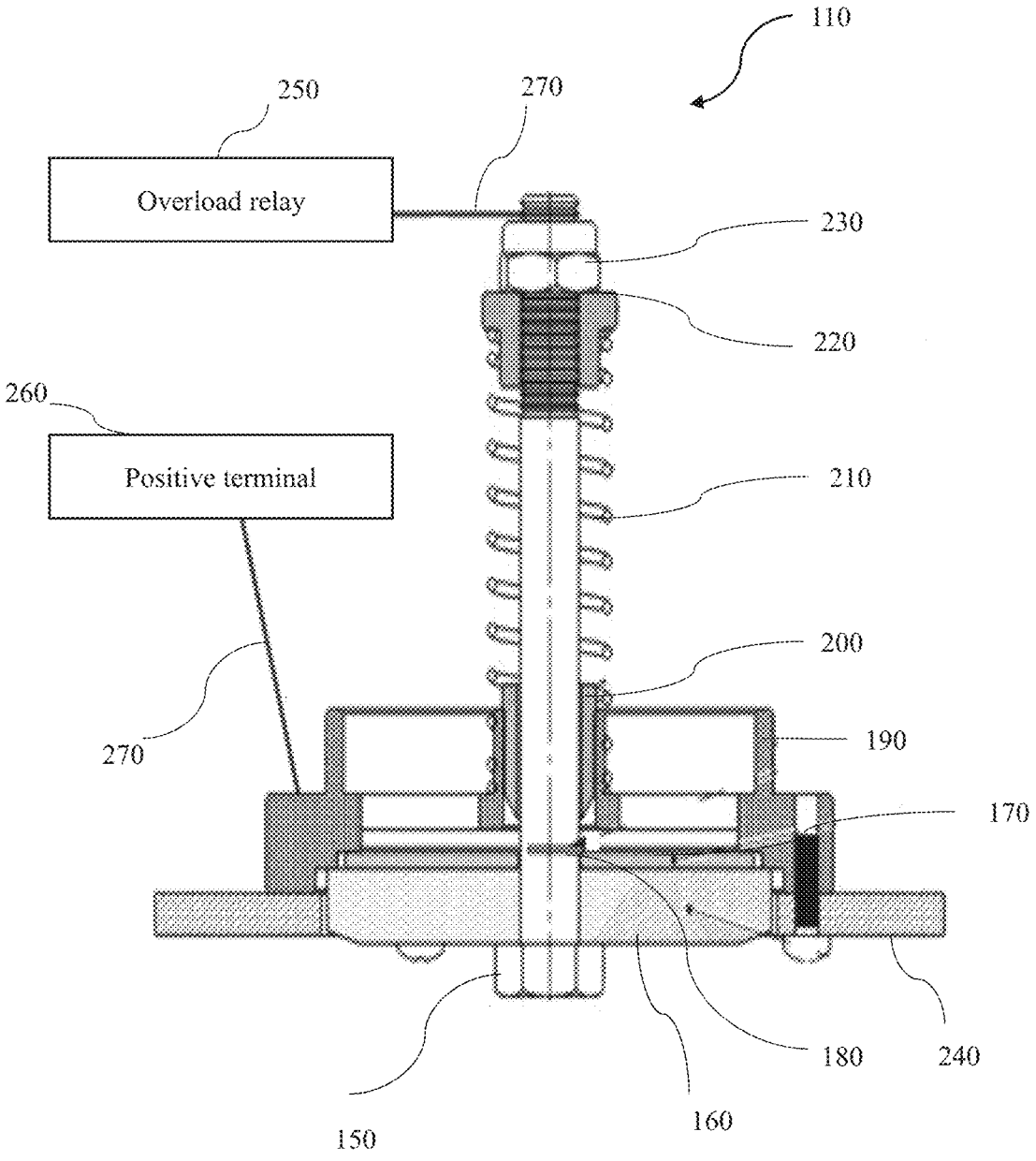
FIG. 5 is a sectional view representation of the overload valve assembly during cabin permissible load condition in accordance with an embodiment of the present disclosure.
Figure 6:
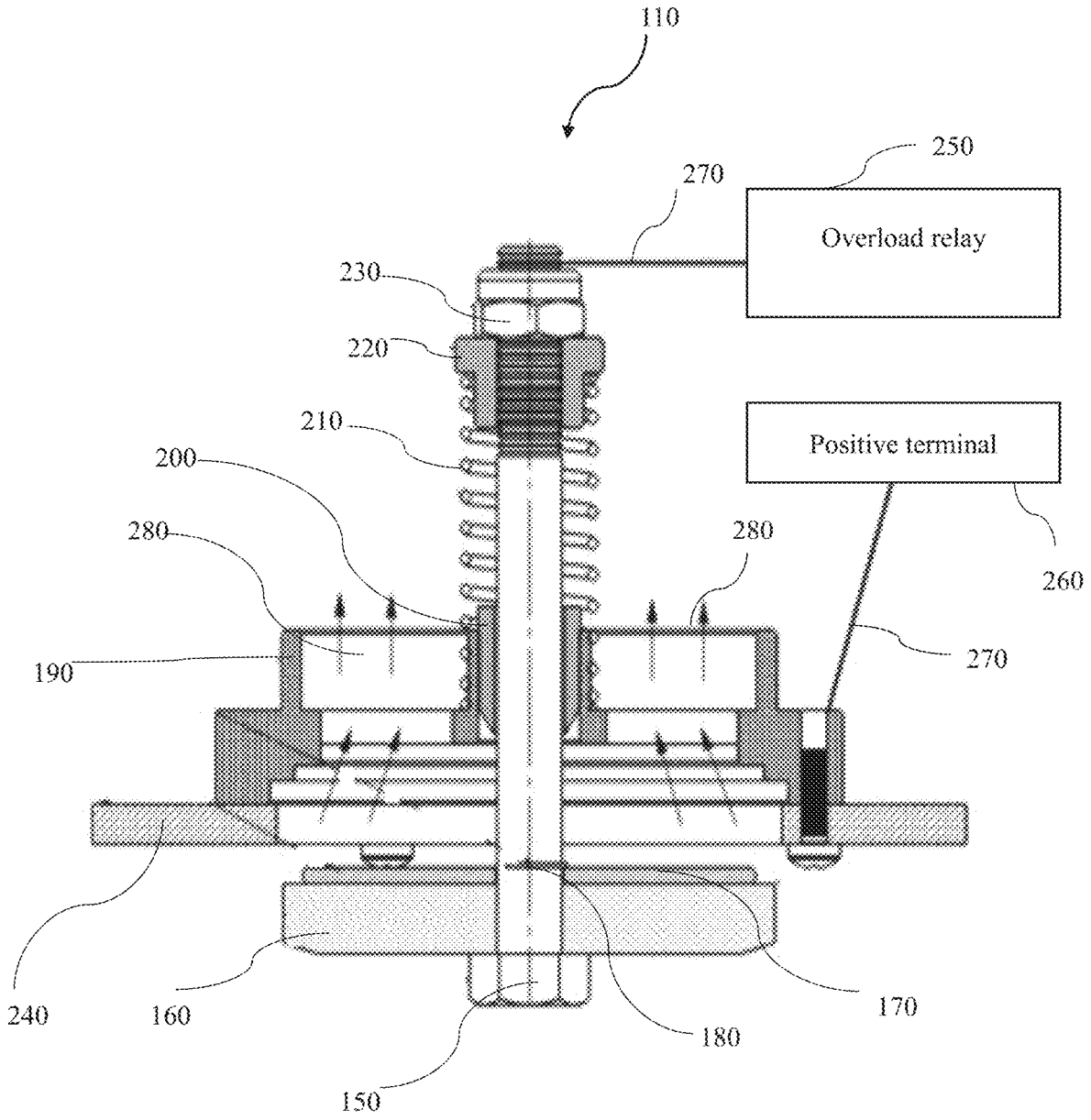
FIG. 6 is a sectional view representation of the overload valve assembly during cabin overload condition in accordance with an embodiment of the present disclosure.

The overload valve assembly 150 also comprises an electrical circuit 270 (as shown in FIG. 5 & FIG. 6) between an overload relay 250 present in the control panel and a positive terminal 260 housed within the control panel via the fastening means 150 and the disc plate 190. The fastening means 150 and the disc plate enable 190 completion of circuit and working of the overload valve assembly 110. Negative terminal is basically the overload relay 250 present in the control panel.

FIG. 5 is a sectional view representation of the overload valve assembly 110 during cabin permissible load condition in accordance with an embodiment of the present disclosure. In operation, during permissible load condition, the electric motor runs normally to move the elevator cabin (CAR) (50) assembly within the cylinder assembly 30. During such normal movement, the arresting plate 170 is touched into the disc plate 190 along with pad 160, without any spring 210 action. It is noted here that, the air is not allowed to flow outside from inner surface of the cylinder assembly 30. In such embodiment, the above mechanism enables the elevator cabin (CAR) 50 assembly movement within the cylinder assembly 30 without the loss in flow of air pressure.

In addition, the disc plate 190 is fixed with an acrylic sheet 240 along with use of three pan head screw. The acrylic sheet 240 is fixed along with the cylinder assembly 30 using special adhesives. In such embodiment, the acrylic sheet 240 is used for high impact resistance property.

FIG. 6 is a sectional view representation of the overload valve assembly 110 during cabin overload condition in correspondence of cabin moving in accordance with an embodiment of the present disclosure. During overload condition, the overload valve assembly 110 reacts through spring 210 tension due to insufficient air pressure on the top seal of the elevator cabin (CAR) 50 assembly. In such embodiment, overload condition refers to a situation where the permissible limit exceeds the loading capacity of the elevator cabin (CAR) 50 assembly.

For spring 210 tension, the arresting plate 170 is moved from the disc plate 190 along with pad 160. Due to such movement, continuity of power is disconnected. Further, the air flow is allowed outside from the inner surface of the cylinder assembly 30. The direction of arrows in FIG. 6 denotes the direction of flow of air. Such total mechanism stops the elevator cabin (CAR) 50 assembly within the cylinder assembly 30. In one specific embodiment, an overload indicator such as LED is used to indicate the overload condition inside the elevator cabin (CAR) 50 assembly.

Present disclosure of an overload valve assembly provides an automatic over-weight detection system for an elevator cabin (CAR) assembly. The disclosed system by help of a spring actuation device and electric signal ensures the maximum permissible limit of pay load in the elevator cabin (CAR) assembly.

While specific language has been used to describe the disclosure, any limitations arising on account of the same are not intended. As would be apparent to a person skilled in the art, various working modifications may be made to the method in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

I claim:

1. An overload valve assembly for a pneumatic vacuum elevator, comprising:

an overload valve unit housed in a head cylinder and connected to top of an elevator cabin (CAR) assembly, the overload valve unit is configured to function based on spring actuation mechanism and ensure the maximum permissible limit of pay load in the elevator cabin (CAR) assembly using an electric, signal sent by an electrical circuit;

characterised by:

a fastener mechanically oriented in an inverted position and affixed over outer top surface of the elevator cabin (CAR) assembly, wherein the fastener comprises a rod, a bolt, an Allen bolt, a stud bolt and a screw;

a pad with a centre hole, inserted into the fastener, wherein the pad being adapted to rest over lower end of the fastener;

an arresting plate with a centre hole inserted into the fastener, wherein the arresting plate being adapted to rest above the pad, wherein the arresting plate and the pad are tightly held over lower end of the fastener by a C-shaped clip;

a disc plate with a centre hole inserted into the fastener mechanically coupled to lower side of the head cylinder, the disc plate comprises extrusion around circumference of the disc plate at lower side, extrusion around the centre hole, and a plurality of holes for out flow of air, wherein the extrusion around circumference of the disc plate at lower side is adapted to house the arresting plate and the pad;

a bottom bush inserted into the fastener and housed inside the extrusion at the centre hole of the disc plate, wherein the bottom bush being adapted to act as an insulator by insulating the fastener means from the disc plate; and a spring of pre-determined spring force, inserted into the fastener and rests above the disc plate;

a top bush bounded with a nut enables fastening of the spring with the disc plate from top end of the fastener, wherein the bottom bush being adapted to act as an insulator.

2. The overload valve assembly as claimed in claim 1, wherein the arresting plate and the pad are adapted to move in tandem from a closed position to an open position, wherein the arresting plate covers the plurality of holes at the closed position, thereby preventing the out flow of air and completing a power circuit, wherein the arresting plate is configured to be pushed down to the open position uncovering the plurality of holes, thereby enabling the out flow of air and disconnecting the power circuit.

3. The overload valve assembly as claimed in claim 1, wherein the spring being adapted to provide spring actuation movement for the movement of the arresting plate and the pad from the closed position to the open position upon detecting a load in the elevator cabin (CAR) assembly more than the permissible limit of pay load.

4. The overload valve assembly as claimed in claim 1, wherein the electrical circuit is located between an overload relay present in a control panel and a positive terminal housed within the control panel via the fastener and the disc plate, wherein the control panel is positioned above the top end of the fastener.

5. A pneumatic vacuum elevator, comprising:

an elevator cylinder adapted to house pneumatic vacuum elevator components, wherein the pneumatic vacuum elevator components comprises:

a head cylinder mechanically affixed just below the ceiling of the top floor for housing an elevator cabin structural sealing unit, at least one motor and an overload valve assembly, wherein the overload valve assembly comprises an overload valve unit configured to function based on spring actuation mechanism and ensure a maximum permissible limit of pay load in the elevator cabin (CAR) assembly using an electric signal sent by an electrical circuit;

a cylindrical elevator cabin (CAR) assembly positioned below the head cylinder and adapted for upward and downward movement through one or more floor levels; and an intermediate cylinder assembly mechanically affixed in between each of the one or more floor levels and adapted to provide space for movement of the cylindrical elevator cabin (CAR) assembly between each of the one or more floor levels.

6. The pneumatic vacuum elevator as claimed in claim 5, wherein the overload valve unit is housed in the head cylinder and connected to top of the elevator cabin (CAR) assembly.

7. The pneumatic vacuum elevator as claimed in claim 5, wherein the overload valve unit comprises:

a fastener mechanically oriented in an inverted position and affixed over outer top surface of the elevator cabin (CAR) assembly;

a pad with a centre hole, inserted into the fastener, wherein the pad being adapted to rest over lower end of the fastener;

an arresting plate with a centre hole inserted into the fastener, wherein the arresting plate being adapted to rest above the pad, wherein the arresting plate and the pad are tightly held over lower end of the fastener by a C-shaped clip;

a disc plate with a centre hole inserted into the fastener mechanically coupled to lower side of the head cylinder, the disc plate comprises extrusion around circumference of the disc plate at lower side, extrusion around the centre hole, and a plurality of holes for out flow of air, wherein the extrusion at lower side is adapted to house the arresting plate and the pad;

a bottom bush inserted into the fastener and housed inside the extrusion at the centre hole of the disc plate, wherein the bottom bush being adapted to act as an insulator by insulating the fastener from the disc plate; and a spring of pre-determined spring force, inserted into the fastener and rests above the disc plate;

a top bush bounded with a nut enables fastening of the spring with the disc plate from top end of the fastener fastening means, wherein the bottom bush being adapted to act as an insulator.

8. The pneumatic vacuum elevator as claimed in claim 7, wherein the arresting plate and the pad are adapted to move in tandem from a closed position to an open position, wherein the arresting plate covers the plurality of holes at the closed position, thereby preventing the out flow of air and completing a power circuit, wherein the arresting plate is configured to be pushed down to the open position uncovering the plurality of holes, thereby enabling the out flow of air and disconnecting the power circuit.

* * * * *